US008154458B2

(12) United States Patent
Li et al.

(10) Patent No.: US 8,154,458 B2
(45) Date of Patent: Apr. 10, 2012

(54) ANTENNA MODULE, METHOD FOR MAKING THE ANTENNA MODULE, AND HOUSING INCORPORATING THE ANTENNA MODULE

(75) Inventors: Zhan Li, Shenzhen (CN); Mei-Wen Fu, Shenzhen (CN); Yi-Mei Wang, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 400 days.

(21) Appl. No.: 12/579,793

(22) Filed: Oct. 15, 2009

(65) Prior Publication Data

US 2011/0018771 A1 Jan. 27, 2011

(30) Foreign Application Priority Data

Jul. 24, 2009 (CN) ..... 2009 1 0304833

(51) Int. Cl.
*H01Q 1/38* (2006.01)

(52) U.S. Cl. ..... 343/700 MS; 343/702; 343/860

(58) Field of Classification Search ..... 343/700 MS, 343/702, 860
See application file for complete search history.

(56) References Cited

U.S. PATENT DOCUMENTS

| | | | | |
|---|---|---|---|---|
| 7,088,307 | B2 * | 8/2006 | Imaizumi | 343/860 |
| 7,382,325 | B1 * | 6/2008 | Chao et al. | 343/702 |
| 2010/0289719 | A1 * | 11/2010 | Wang et al. | 343/895 |

* cited by examiner

*Primary Examiner* — Dieu H Duong
(74) *Attorney, Agent, or Firm* — Altis Law Group, Inc.

(57) ABSTRACT

An antenna module includes a first antenna structure, a second antenna structure, a first insulating layer, and a matching unit. The first antenna structure includes a plurality of first antenna layers, second insulating layers respectively positioned between each two adjacent first antenna layers, and first conductive portions respectively connecting to two adjacent first antenna layers. The second antenna structure includes a plurality of second antenna layers, third insulating layers respectively positioned between each two adjacent second antenna layers, and second conductive portions respectively connecting to two adjacent second antenna layers. The first insulating layer is positioned between the first antenna structure 22 and the second antenna structure. The matching unit is filled in the first insulating layer and electrically connects first antenna structure to the second antenna structure.

10 Claims, 4 Drawing Sheets

ANTENNA MODULE, METHOD FOR MAKING THE ANTENNA MODULE, AND HOUSING INCORPORATING THE ANTENNA MODULE

BACKGROUND

1. Technical Field

The present disclosure relates to an antenna module, a method of manufacturing the antenna module and a housing of a portable electronic device having the antenna module.

2. Description of Related Art

Portable electronic devices, such as mobile phones, personal digital assistants (PDAs), and laptop computers are widely used. Most of these portable electronic devices have antenna modules for receiving and sending wireless signals.

Referring to FIG. 4, a related antenna module used in a portable electronic device is provided. The antenna module includes an outer layer 91, an antenna layer 92, an inner layer 93, a conductive terminal 94, a printed circuit board (not shown), and a conductive post 95 connecting to the printed circuit board. The outer layer 91 is a plastic film for supporting the antenna layer 92. The antenna layer 92 is attached to and located between the outer layer 91 and the inner layer 93. The conductive terminal 94 electrically contacts the antenna layer 92 and extends to connect to the conductive post 95.

However, to provide for multiple functions, the portable electronic device typically has a plurality of antenna modules. However, additional antenna modules will typically enlarge the overall portable electronic device.

Therefore, there is a room for improvement within the art.

BRIEF DESCRIPTION OF THE DRAWINGS

Many aspects of a new antenna module, a new method for making the antenna module, and a new housing integrating the antenna can be better understood with reference to the following drawings. The components in the drawings are not necessarily to scale, the emphasis instead being placed upon clearly illustrating the antenna module, method for making the antenna module, and housing integrating the antenna. Moreover, in the drawings, like reference numerals designate corresponding parts throughout the several views.

DETAILED DESCRIPTION

Figure 1:
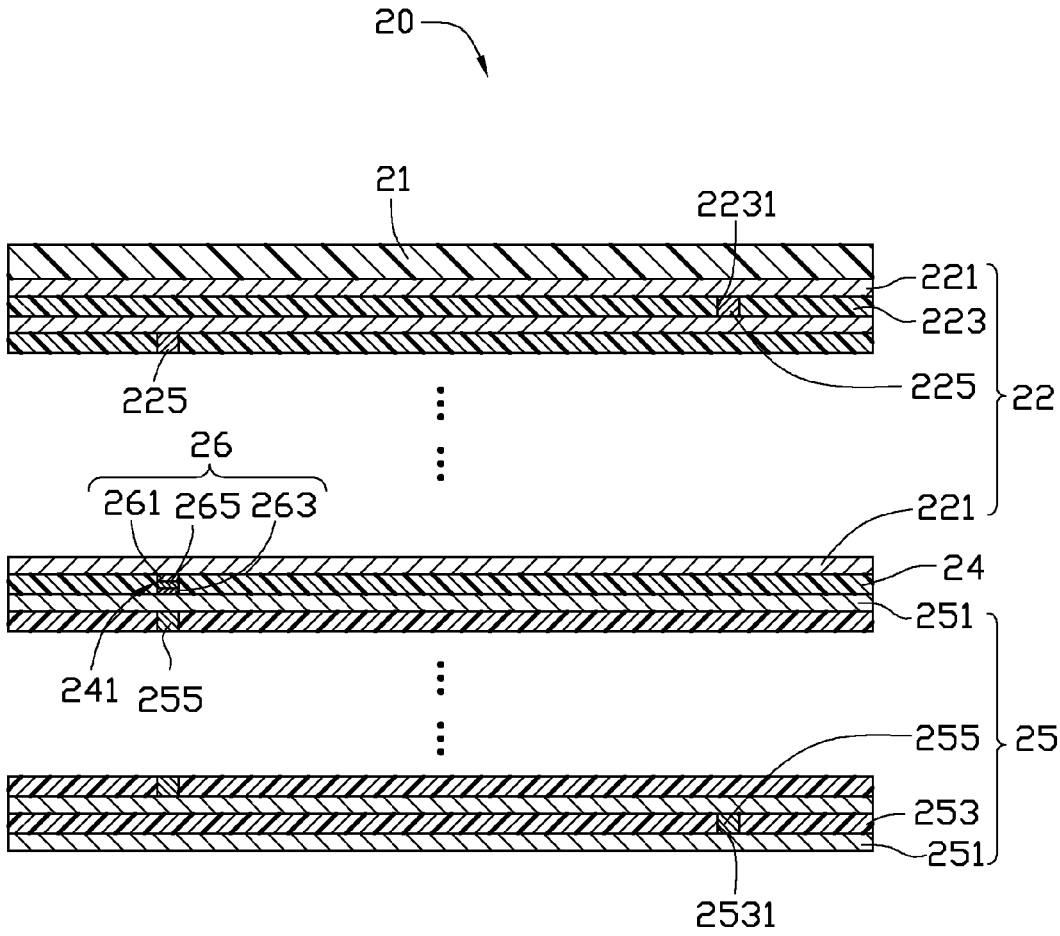
FIG. 1 is a cross-sectional view of an antenna module according to a first exemplary embodiment.

FIG. 1 shows a first exemplary antenna module 20 including a carrying layer 21, a first antenna structure 22 formed on the carrying layer 21, a first insulating layer 24, a second antenna structure 25, and a matching unit 26. The first insulating layer 24 is positioned between the first antenna structure 22 and the second antenna structure 25.

The first antenna structure 22 includes a plurality of first antenna layers 221, a plurality of second insulating layers 223, and a plurality of first conductive portions 225. Each of the second insulating layers 223 is positioned between each two adjacent first antenna layers 221. Each of the second insulating layers 223 defines a first through hole 2231. Each of the first conductive portions 225 is formed/filled in the first through hole 2231. Each of the first conductive portions 225 has two ends connecting to each two adjacent first antenna layers 221 respectively.

The second antenna structure 25 includes a plurality of second antenna layers 251, a plurality of third insulating layers 253, and a plurality of second conductive portions 255. Each of the third insulating layers 253 is positioned between each two adjacent second antenna layers 251. Each of the third insulating layers 253 defines a second through hole 2531. Each of the second conductive portions 255 is formed/filled in the second through hole 2531. Each of the second conductive portions 255 has two ends connecting to two adjacent second antenna layers 251, respectively. Accordingly, the first antenna structure 22 and the second antenna structure 25 can receive and transmit signals at two different radio frequencies.

The carrying layer 21 is made of a resin material selected from a group consisting of polycarbonate (PC), acrylonitrile-butadiene-styrene (ABS), and polyethylene terephthalate (PET).

The first antenna layers 221 and the second antenna layers 251 can be films made of conductive inks. Antenna patterns are formed on the first antenna layers 221 and the second antenna layers 251. The first insulating layer 24, the second insulating layers 223, and the third insulating layers 253 can be printed dielectric ink films.

The first conductive portions 225 and the second conductive portions 255 can be formed by filling printed conductive inks into the first through hole 2231 and the second through hole 2531. The matching unit 26 acts as a capacitor and includes a first pole portion 261, a second pole portion 263, and an insulating portion 265. The first pole portion 261 and the second pole portion 263 can be made of printed conductive ink. The insulating portion 265 is positioned between the first pole portion 261 and the second pole portion 263.

During manufacturing of the antenna module 20, the conductive ink is printed on the carrying layer 21 to form the first antenna layers 221. Dielectric ink can be printed on the surface of the first antenna layer 221 to form the second insulating layers 223. The second insulating layers 223 have the first through hole 2231. Thus, the first antenna layer 221 is exposed from the first through hole 2231. The antenna patterns can be formed on the surface of the second insulating layers 223 to form another first antenna layers 221. The conductive ink is filled into the first through hole 2231 to form the first conductive portion 225. The first antenna layers 221 is electrically connected to another adjacent one first antenna layer 221 by the first conductive portion 225.

The second insulating layers 223 and the first antenna layers 221 are alternately stacked to form the first antenna structure 22. The first insulating layer 24 is formed on the first antenna layer 221 and defines a through hole 241. The conductive ink is filled in the through hole 241 to form the matching unit 26. The second antenna layer 251 is attached to the first insulating layer 24. Accordingly, the first antenna structure 22 and the second antenna structure 25 are electrically connected to each other by the matching unit 26. The first antenna structure 22 and the second antenna structure 25 can transmit signals therebetween.

The method for making the second antenna structure 25 has substantially the same steps as the first antenna structure 22.

Figure 2:
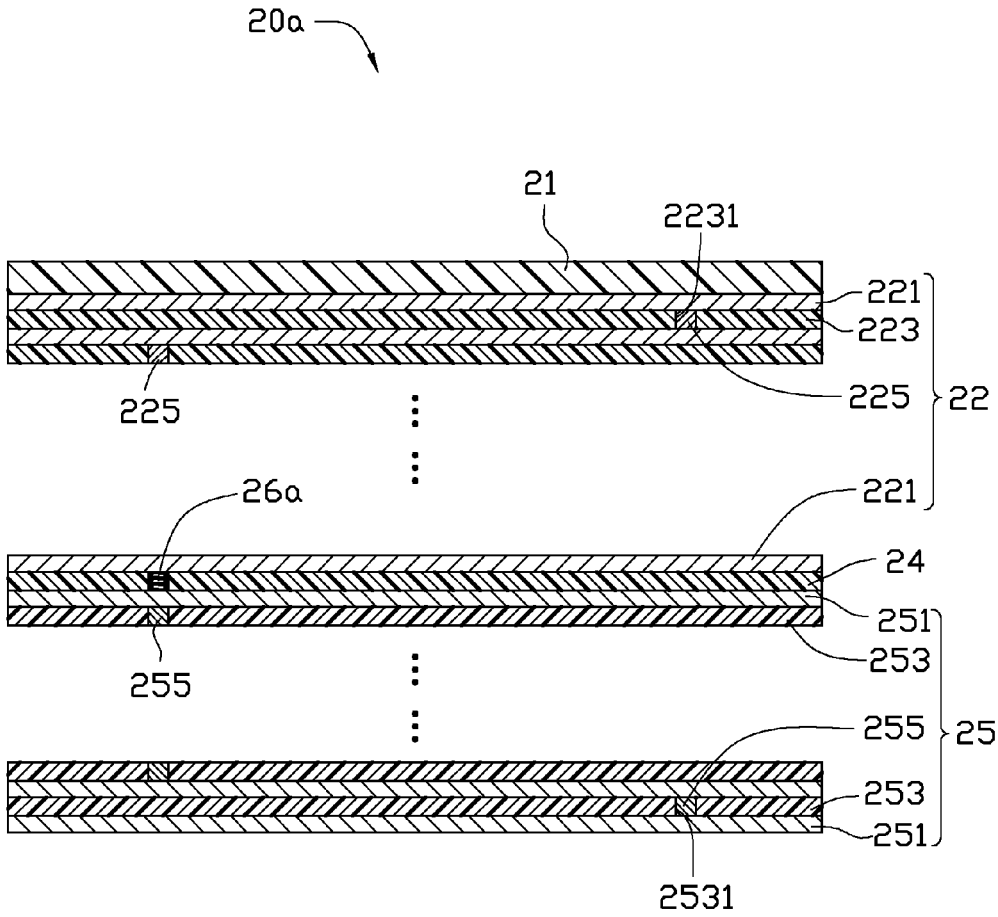
FIG. 2 is a cross-sectional view of an antenna module according to a second exemplary embodiment.

FIG. 2 shows a second exemplary antenna module 20 having generally the same structure as the first antenna module 10 except for including a matching unit 26*a*. The matching unit 26*a* can be an inductor to conduct signals. The matching unit 26*a* can be made of nano crystalline alloy.

Figure 3:
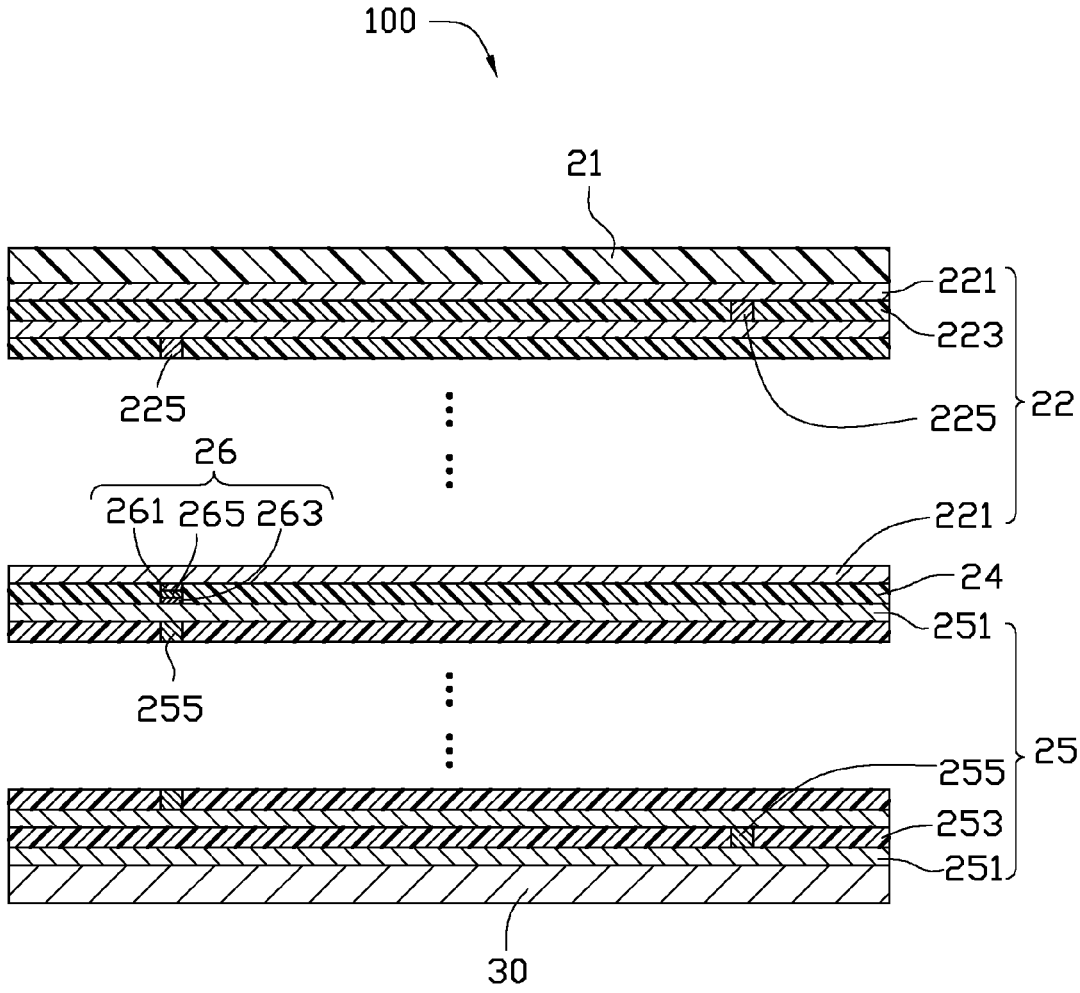
FIG. 3 is a cross-sectional view of a housing according to the exemplary embodiment.
Figure 4:
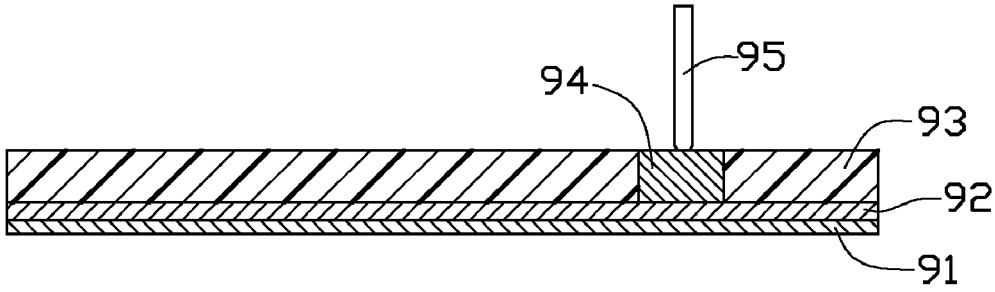
FIG. 4 (RELATED ART)
FIG. 4 is a cross-sectional view of a portable electronic device using a related antenna module.

FIG. 3 shows a housing 100 including a base 30 and the antenna module 20. The antenna module 20 is integrally formed with the base 30 using an injection molding process. The base 30 can be made of resin, such as silicone resin, thermoplastic resin etc.

During making of the housing 100 the antenna module 20 is placed into an injection mold (not shown). The carrying layer 21 is attached to the injection mold. The resin is injected into the injection mold. The base 30 is formed on the second antenna layers 251 and located opposite to the carrying layer 21.

It is to be understood that the base 30 can be formed on the third insulating layer 253 and located opposite to the carrying layer 21. Accordingly, the second antenna layers 251 may be protected by the third insulating layer 253.

It is to be understood that the first pole portion 261 can be omitted. Accordingly, the first antenna layers 221 can be used as the first pole portion 261.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An antenna module, comprising:

a first antenna structure including a plurality of first antenna layers, second insulating layers respectively positioned between each two adjacent first antenna layers, and first conductive portions respectively connecting to two adjacent first antenna layers;

a second antenna structure including a plurality of second antenna layers, third insulating layers respectively positioned between each two adjacent second antenna layers, and second conductive portions respectively connecting to two adjacent second antenna layers;

a first insulating layer positioned between the first antenna structure and the second antenna structure; and a matching unit filled in the first insulating layer and electrically connecting first antenna structure to the second antenna structure.

2. The antenna module as claimed in claim 1, wherein the first antenna layers and the second antenna layers are made of conductive inks.

3. The antenna module as claimed in claim 2, wherein the matching unit is a capacitor or inductor.

4. The antenna module as claimed in claim 3, wherein the matching unit is an inductor made of a nano crystalline alloy.

5. The antenna module as claimed in claim 1, wherein the first insulating layer, the second insulating layers, and the third insulating layers are made of dielectric inks.

6. A method for making an antenna module, comprising:

providing a carrying layer;

providing a first antenna structure formed on the carrying layer, the first antenna structure including a plurality of first antenna layers, second insulating layers respectively positioned between each two adjacent first antenna layers;

providing first insulating layer formed on the first antenna layer opposite to the carrying layer;

providing a second antenna structure formed on the first insulating layer, the second antenna structure including a plurality of second antenna layers, third insulating layers respectively positioned between each two adjacent second antenna layers;

providing a matching unit filled in the first insulating layer and electrically connecting first antenna structure to the second antenna structure.

7. The method for making an antenna module as claimed in claim 6, wherein the first insulating layer, the second insulating layers, and the third insulating layers are made of dielectric inks.

8. The method for making an antenna module as claimed in claim 6, wherein the second insulating layers are respectively defines a first through hole, the first antenna structure further includes a plurality of first conductive portions formed within the first through hole formed within the first through hole, each of the first conductive portions has two ends respectively connect to two adjacent first antenna layers.

9. A housing, comprising:

an antenna module comprising:

a first antenna structure including a plurality of first antenna layers, second insulating layers respectively positioned between each two adjacent first antenna layers, and first conductive portions respectively connecting to two adjacent first antenna layers;

a second antenna structure including a plurality of second antenna layers, third insulating layers respectively positioned between each two adjacent second antenna layers, and second conductive portions respectively connecting to two adjacent second antenna layers;

a first insulating layer positioned between the first antenna structure and the second antenna structure; and a matching unit filled in the first insulating layer and electrically connecting first antenna structure to the second antenna structure; and a base attached to the antenna module.

10. The housing as claimed in claim 9, wherein the base is attached to the third insulating layer opposite to the carrying layer.

* * * * *